US006871418B2

(12) United States Patent
Raychaudhuri et al.

(10) Patent No.: US 6,871,418 B2
(45) Date of Patent: Mar. 29, 2005

(54) APPARATUS AND RELATED METHOD FOR RAPID CURE OF SOL-GEL COATINGS

(75) Inventors: Satyabrata Raychaudhuri, Thousand Oaks, CA (US); Trevor Merritt, West Hills, CA (US); Zhibang Jim Duan, Thousand Oaks, CA (US)

(73) Assignee: Yazaki Corporation (JP)

( * ) Notice: Subject to any disclaimer, the term of this patent is extended or adjusted under 35 U.S.C. 154(b) by 383 days.

(21) Appl. No.: 10/024,838

(22) Filed: Dec. 19, 2001

(65) Prior Publication Data

US 2002/0094385 A1 Jul. 18, 2002

Related U.S. Application Data

(60) Provisional application No. 60/257,916, filed on Dec. 20, 2000.

(51) Int. Cl.[7] ..... F26B 3/34

(52) U.S. Cl. ..... 34/267; 34/274; 34/420

(58) Field of Search ..... 34/266, 267, 273, 34/274, 420, 423, 459, 68, 623

(56) References Cited

U.S. PATENT DOCUMENTS

| | | | | | |
|---|---|---|---|---|---|
| 4,143,468 | A | | 3/1979 | Novotny et al. | 34/1 |
| 4,246,297 | A | | 1/1981 | Nablo et al. | 427/44 |
| 4,535,548 | A | | 8/1985 | Hyde | 34/4 |
| 4,704,299 | A | | 11/1987 | Wielonski et al. | 427/38 |
| 4,957,725 | A | | 9/1990 | Potember et al. | 423/592 |
| 5,319,861 | A | * | 6/1994 | Tate | 34/267 |
| 5,343,633 | A | * | 9/1994 | Wang et al. | 34/92 |
| 5,473,826 | A | * | 12/1995 | Kirkbir et al. | 34/405 |
| 5,626,670 | A | | 5/1997 | Varshney et al. | 117/7 |
| 5,856,018 | A | * | 1/1999 | Chen et al. | 428/448 |
| 5,888,592 | A | | 3/1999 | Biallas et al. | 427/542 |
| 6,125,549 | A | * | 10/2000 | Pikus | 34/267 |

FOREIGN PATENT DOCUMENTS

| | | |
|---|---|---|
| DE | 41 36 920 A1 | 5/1993 |
| EP | 1 154 289 A1 | 11/2001 |
| WO | WO 00/65643 | 11/2000 |

* cited by examiner

*Primary Examiner*—Denise L. Esquivel
*Assistant Examiner*—Kathryn S. O'Malley
(74) *Attorney, Agent, or Firm*—Sheppard, Mullin, Richter & Hampton LLP

(57) ABSTRACT

This invention resides in an apparatus and related method for rapidly curing thin film sol-gel coatings, particularly such coatings adhered to low melting temperature plastic substrates, whether rigid or flexible, without deforming the substrate. The curing is achieved using IR heating lamps and dry or humid hot gas flow. This curing densities the sol-gel coating and provides desired optical and mechanical properties. The use of IR lamps and hot-gas nozzles, either singularly or in combination, produces a rapid cure by effectively heating the thin film coating layer. In this manner, a sufficiently high temperature can be attained in the film layer, to densify the sol-gel coating, but for a sufficiently short time duration to avoid melting or otherwise deforming the substrate. The sol-gel coatings can be cured two to three orders of magnitude faster than with conventional oven curing, leading to significant cost reductions and manufacturing efficiency.

28 Claims, 4 Drawing Sheets

APPARATUS AND RELATED METHOD FOR RAPID CURE OF SOL-GEL COATINGS

This application claims the benefit of U.S. Provisional Application No. 60/257,916, filed Dec. 20, 2000.

BACKGROUND OF THE INVENTION

This invention relates generally to thin-film sol-gel coatings and, more particularly, to curing thin-film sol-gel coatings applied to substrates having a low melting temperature.

Sol-gel materials have found numerous uses in commercial and industrial products, including for example forming near net shape objects, encasing optical fibers, and providing antireflection coatings for display devices. Sol-gel coatings typically are formulated by mixing together an alkoxide, an alcohol, and water to produce a pre-polymerized solution, or sol. The pre-polymerized solution is applied to a substrate by any of several methods, including dip coating, spin coating, spray coating, gravure coating, and meniscus coating. Each such application causes a prescribed amount of the solution to adhere to the substrate. The adhered solution is then cured to form a separate polymerized layer on the substrate. In many applications, particularly in the case of optical coatings, multiple sol-gel layers comprising different sol compositions with different optical indices can be applied to the substrate, in order to achieve desired optical properties. U.S. Pat. No. 5,856,018, issued to Chen, et al., which is incorporated by reference, describes one suitable use of sol-gel coatings for producing an antireflection coating.

In all cases, it is necessary to properly cure the wet sol layer after it has adhered to the substrate. Curing, which usually is accomplished by applying heat energy in an oven, evaporates residual organics and other liquid compounds of the solution from the adhered layer. The curing process, performed at elevated temperatures for a certain time duration, densifies the layers. Generally, the higher the temperature, the better the cure; and the longer the exposure to temperature, the better the cure. A trade-off exists between the duration of time the coating is held at an elevated temperature and the value of that temperature. Higher temperatures require a shorter exposure time. The temperature preferably is selected to be the maximum temperature that the particular substrate can withstand without deformation. The temperature, as well as the duration of the cure, affects the mechanical strength of the resulting layer, such as its scratch resistance or its adhesion. An incomplete cure will result in reduced mechanical properties.

Difficulties can arise when the substrate is formed of a low melting point material such as polymethyl methacrylate (PMMA), polycarbonate (PC), or other plastics. In such cases, the cure temperature must be maintained below about 100 to 150° C., depending on the particular substrate material, to avoid melting or warping the substrate. To provide sufficient curing energy at these low temperatures for achieving satisfactory densification and mechanical strength, long curing times, on the order of tens of minutes or even hours, typically are required. This can increase substantially the processing time and cost of the product, sometimes making the product economically non-viable.

It should, therefore, be apparent that there is a need for an apparatus and method for rapidly curing sol-gel coatings applied to low-melting point substrates, without warping or otherwise damaging the substrates, which yields dense and mechanically strong coatings, with a relatively short processing time. The present invention fulfills this need.

SUMMARY OF THE INVENTION

The present invention resides in an improved apparatus for rapidly curing a sol-gel coating adhered to a substrate, without warping or otherwise damaging the substrate. The apparatus includes a heating source configured to generate a predetermined heating pattern and an assembly configured to sequentially expose discrete portions of the coated substrate to the heating pattern at a selected distance and for a selected duration, such that the heat energy sufficiently cures or densifies the sol-gel coating, but does not unduly heat the substrate to cause deformation.

The invention also resides in a method for rapidly curing a sol-gel coating adhered to a substrate. The method includes passing the coated substrate sequentially past a heating source, wherein the resulting heat energy sufficiently cures or densities the sol-gel coating to its optimum physical and optical properties, but does not unduly heat the substrate to cause deformation.

The heating source preferably includes two modes for heating the sol-gel coating for densification—IR radiation and hot gas, thereby transferring heat to the sol-gel layer from both its inside, i.e., the side contacting the plastic substrate, and its outside, i.e., the side exposed to the ambient.

In a detailed feature of the invention, moisture can be introduced into the curing process by injecting steam, or other water forms, into the heated gas stream.

In another detailed feature of the invention, the temperature of the heated gas stream is in the range of about 100 to about 500° C., and the flow rate of the heated gas stream is in the range of about 50 to about 10,000 cubic centimeters per second.

Preferably, the coated substrate is sequentially exposed to the heating source at a predetermined speed selected to allow sufficient heat to flow into the sol-gel layer to densify the film and achieve the best optical and mechanical properties. In yet another detailed feature of the invention, the coated substrate is exposed at a speed in the range of about 0.5 to about 50 centimeters per second.

The invention is particularly beneficial for sol-gel oxide coatings, e.g., $SiO_2$ and $TiO_2$, that are used for optical coatings and for antireflection coatings. The sol-gel coatings themselves can withstand high temperatures, in excess of 500° C. At such high temperatures, a very rapid cure (densification) can be effected. However, for coatings that are adhered to substrates having a relatively low melting temperature, such high temperatures could damage the substrate. Preferably, the substrate and sol-gel coating are heated using a combination of heating modes to as high a temperature as possible for a short duration of time, providing the required densification of the sol-gel films, but without damaging the substrate. The process can be repeated to produce a product having multiple layers of sol-gel coatings.

Other features and advantages of the invention should become apparent from the following description of the preferred embodiments, taken in conjunction with the accompanying drawings, which illustrate, by way of example, the principles of the invention.

BRIEF DESCRIPTION OF THE DRAWINGS

Embodiments of the present invention will now be described, by way of example only, with reference to the following drawings in which:

FIG. 4A depicts the nozzle configuration, while FIG. 4B illustrates heating of gas and adding moisture to the gas.

DESCRIPTION OF THE PREFERRED EMBODIMENTS

Figure 1:
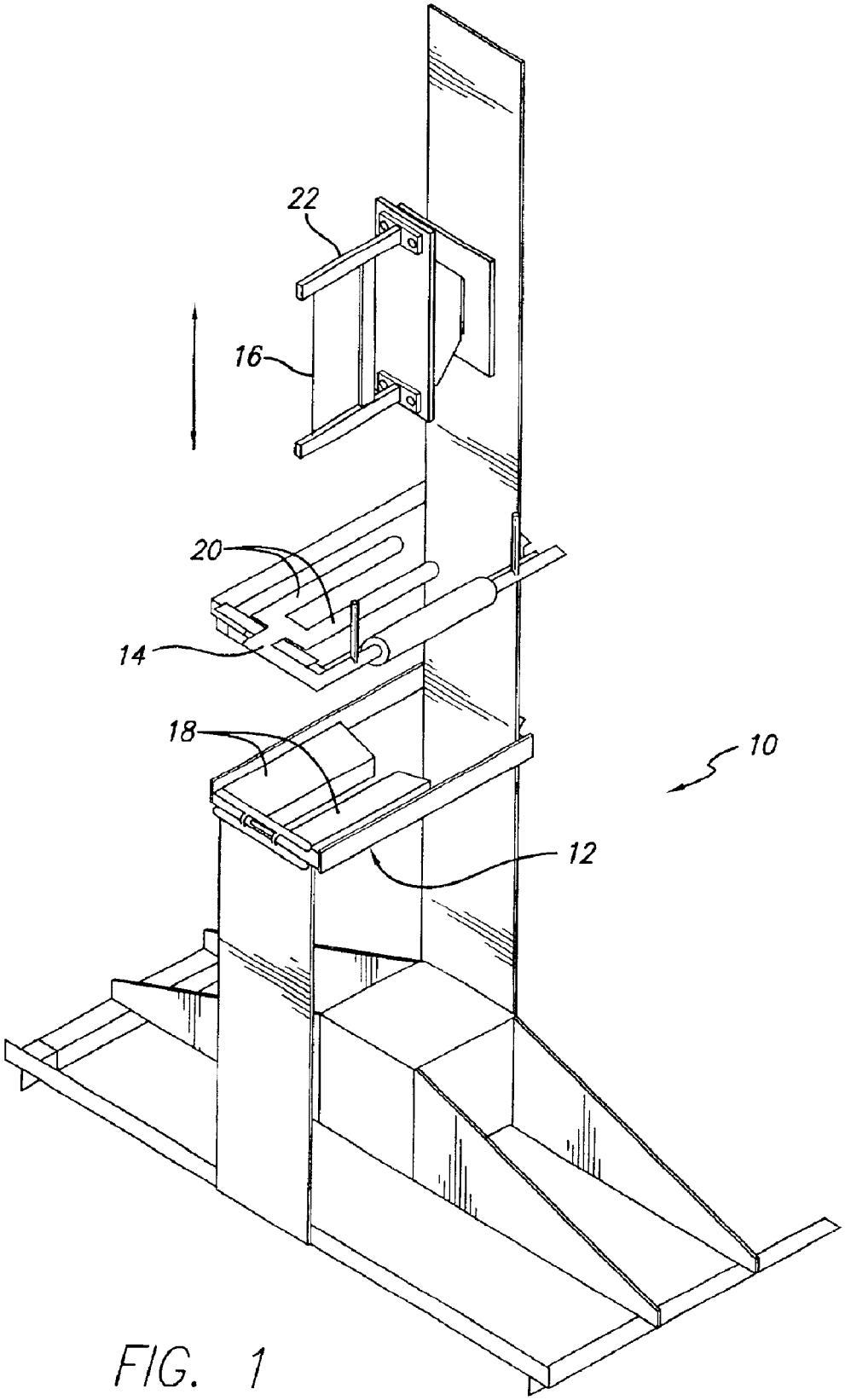
FIG. 1 is a perspective view of an apparatus for transporting the substrate past an IR lamp array and a hot-gas nozzle array in accordance with this invention.

In this section, the present invention is described in detail with regard to the figures briefly described above. With reference to the illustrative drawings, and particularly to FIG. 1, there is shown a preferred embodiment of the present invention in a curing apparatus 10, having an IR assembly 12 and a hot-gas assembly 14, used in the rapid cure of sol-gel coatings on a substrate. This embodiment is configured to cure a coated substrate 16 with sol-gel adhered to both sides of the substrate. Specifically, two opposing IR lamps 18 and two opposing hot-gas nozzle assemblies 20 are sequentially arranged. The coated substrate is attached to a transport assembly 22 and is passed through the two heat sources in order to effect a curing of the adhered sol-gel coating on each side. In other embodiments, the heat sources can be passed over a stationary substrate in a manner to effect curing.

With continued reference to FIG. 1, both the IR energy and the hot gas flow emitted by the IR assembly 12 and the hot-gas assembly 14, respectively, are directed generally perpendicular to the surface of the coating, which means they also are perpendicular to the direction of movement of the substrate during the curing. It is important that the substrate with adhered sol-gel coating be moving continuously during this cure phase. In other embodiments, curing also can be done in a continuous, in-line process. Beneficially, curing can be effected in a matter of seconds, which is a factor of 100 to 1000 faster than previous oven cures. Because an oven cure is static, the entire substrate must be exposed to the higher temperature for the total cure time, thereby increasing the possibilities of warpage.

Figure 2A:
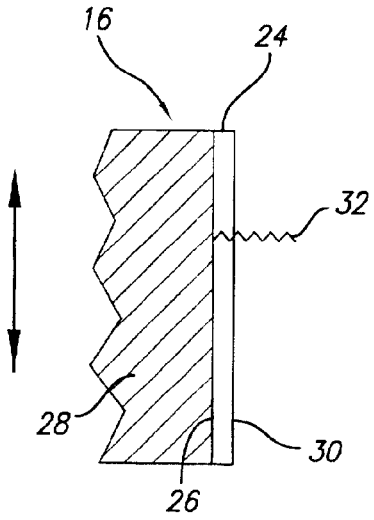
FIGS. 2A and 2B show a cross-sectional view of a sol-gel coating adhered to one side of a plastic substrate, also depicting the inward and outward heat paths during densification.
Figure 2B:
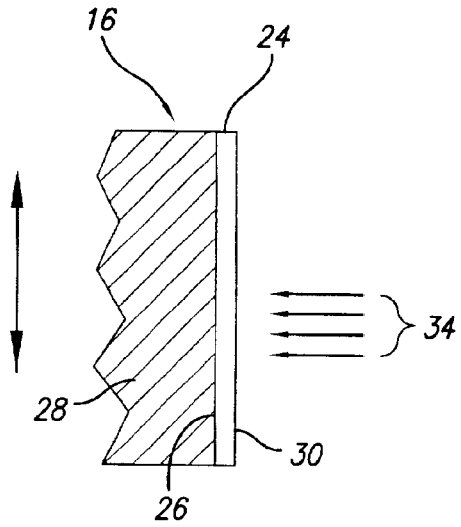

As shown in FIGS. 2A and 2B, it is advantageous to transfer heat to the sol-gel coating 24 from both sides; i.e., from the inside 26, i.e., the side contacting the plastic substrate 28, and from the outside 30, i.e., the side exposed to the ambient. With reference to FIG. 2A, the IR energy 32 from the IR lamps 18 couples readily with the plastic substrate and heats it up rapidly. This effectively transfers heat to the sol-gel layers from the inside outward. The sol-gel layer itself also is heated by partially absorbing some of the IR energy from the lamps. With reference to FIG. 2B, the hot gas flow 34 impinging on the outer surface of the sol-gel coating applies heat from the outside inward. As a result of this combination of heat sources, the sol-gel layer receives sufficient heat energy to rapidly densify. At any one moment during the cure, only a narrow width of the plastic substrate with the sol-gel coating is exposed to the heat sources, because the substrate is moving vertically past the heat sources at a predetermined speed. Therefore, insufficient heat is absorbed by the plastic substrate to elevate its temperature to cause the substrate to soften or deform.

Factors influencing the IR heat energy imparted to the adhered sol-gel coating 24 include: the power of the lamps, the distance from the lamps to the substrate, and the speed at which the substrate traverses the lamp. These parameters can be experimentally chosen so that the IR energy quickly and efficiently heats and cures the coating, without significantly penetrating into the substrate.

Likewise, factors influencing the hot gas heat energy imparted to the adhered sol-gel coating 24 include: the temperature of the gas, the flow rate of the gas, the distance between the nozzle and the coated surface, and the speed at which the substrate traverses the nozzle. If moisture is added to the gas, the amount of water will also affect the heat energy. These parameters can be chosen experimentally so that the energy in the gas quickly and efficiently heats and cures the coating, without significantly penetrating into the substrate. Thus, even if the coated substrate is formed of a plastic material having a relatively low melting temperature, the substrate does not warp or melt during the curing process.

Figure 3:
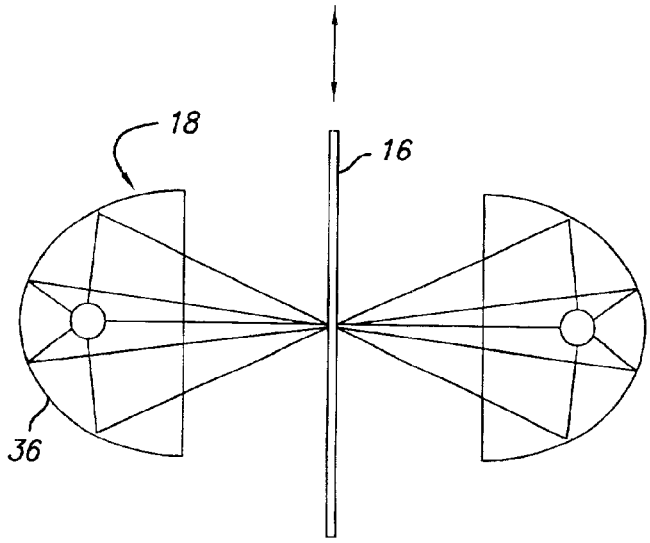
FIG. 3 is a schematic side view of an IR curing apparatus having two IR lamps, each focused on the nearest surface of the substrate as it passes perpendicularly between them.

FIG. 3 depicts the IR assembly 12 utilizing two commercial IR lamps 18, Model #5193-10, manufactured by Research Inc., of Eden Prairie, Minn., which each incorporate a standard parabolic focusing reflector 36. Optimally, each IR lamp is positioned such that the sol-gel coated surface on the adjacent side of the substrate is located at the parabolic reflector's focal point. Each lamp has a focal length of 2 inches, and the separation between the two lamps is typically 4 inches plus the thickness of the substrate. The lamps have an output power range of 0 to 80 watts per centimeter. The lamps are fixed in place, and the transport assembly 22 to which the substrate is attached passes the coated substrate perpendicularly between them, as shown in FIG. 1. The transport assembly can have a linear speed range of 0.5 to 50 cm/s.

The optimal curing energy is determined by the combination of IR lamp power and substrate speed. If the lamp power is too high or if the transport speed is too slow, significant heat energy will penetrate the substrate and cause warping or melting. Conversely, if the lamp power is too low or the transport speed is too high, an insufficient cure will occur and the coating will have poor mechanical properties. To achieve the quickest cure, the highest lamp power is typically used in conjunction with a transport speed that is empirically determined to provide a full cure, but without softening the plastic substrate.

Figure 4A:
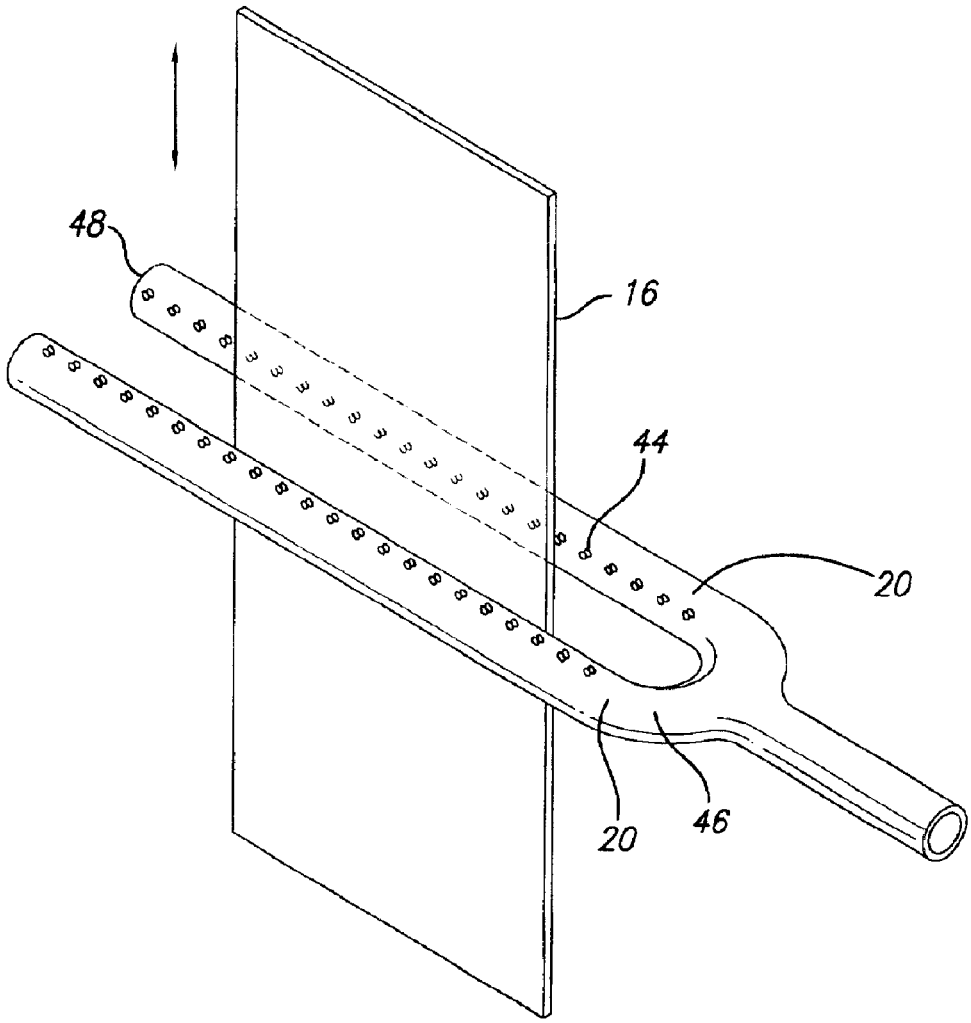
FIGS. 4A and 4B are schematic drawings of a hot-gas curing apparatus having two nozzle assemblies, each focused on the nearest surface of the substrate as it passes perpendicularly between them.

FIG. 4A depicts two opposing hot-gas nozzle assemblies 20, again for curing sol-gel coatings adhered to both sides of the substrate. Any of a number of gases may be used, including for example air, nitrogen ($N_2$), argon (Ar), helium (He), or a combination of such gases. The actual gas(es) chosen depends on such factors as the gas' economic cost, the gas' specific heat, and the nature of the sol-gel coating being cured. Gas may be supplied from a pressurized cylinder, or it may be circulated using a blower arrangement. It is important that the gas be free of particulates so that no foreign objects or defects are introduced into the sol-gel coatings. High-purity gas can be purchased or it can be produced by filtering prior to usage.

Figure 4B:
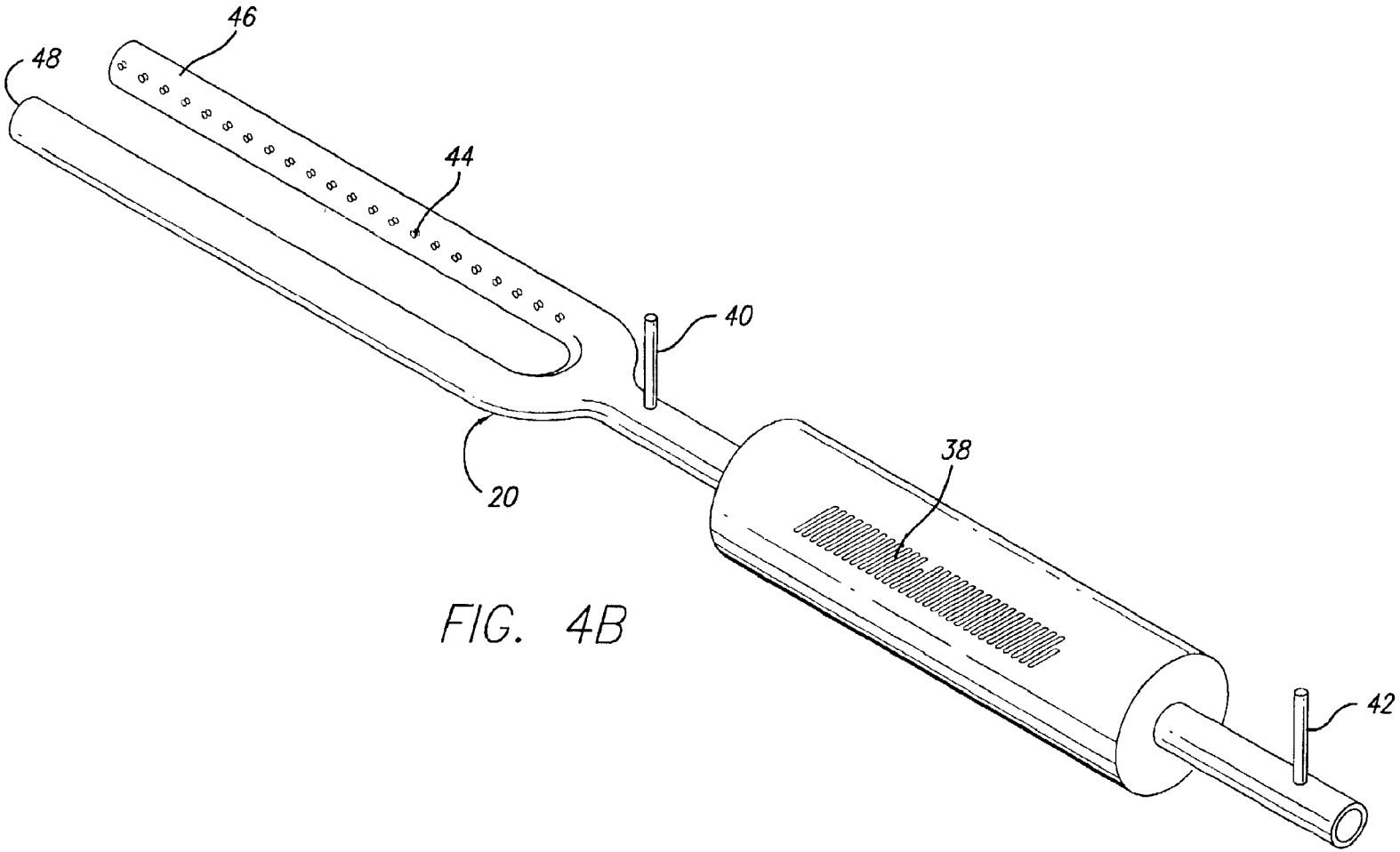

The gas can be heated by several alternative means. One particularly straightforward approach to heat and control the gas temperature is by means of a hot wire filament 38, illustrated in FIG. 4B. Electrical current is controllably supplied to the filament to maintain the gas' temperature at a selected value, as determined by a thermocouple 40. Gas temperatures can be controlled to any selected value in the range of 100 to above 500° C. A particularly useful temperature range is 300 to 400° C. If it is desired to supply moisture during the cure process, steam or other forms of moisture can be injected into the gas stream via a moisture injection port 42.

The nozzles for the hot gas should provide a uniform linear distribution of the gas across the sol-gel coating. FIG. 4A shows one suitable configuration for achieving this, including rows of uniformly spaced holes 44 drilled into copper tubing 46 that is sealed at its distal end 48. Those skilled in the art will appreciate that numerous alternative nozzle configurations could provide the desired uniform gas flow. The gas flow rate can be varied from less than 50 cc/s to more than 10,000 cc/s. A satisfactory flow rate range for the illustrated configuration is in the range of 250 to 2500 cc/s. The gas flow preferably is maintained in the laminar flow regime for optimum uniformity in delivering the heat energy to cure the sol-gel coating. Parameters for achieving laminar flow are determined by the geometry of the nozzles, the spacing of nozzle array from substrate, and the gas flow rate.

The invention provides an efficient way to quickly cure the sol-gel coating after it has been applied to the substrate, thus making the product economically feasible to manufacture. It should be recognized that film requirements vary from application to application. Accordingly, it may not be necessary to use both curing methods. In such cases, the heating methods of this invention can be used individually, either IR lamps only or hot air only, depending upon the desired results. It may also be advisable to use a humidity-controlled environment during the curing.

Also, it should be clear to those skilled in the art that if only one side of the substrate is coated with sol, such as by a spin coating application, then the heat sources need consist of only one heat lamp and one gas nozzle array, arranged on the coated side of the substrate. In this case, the curing parameters for the IR lamp and the hot-gas nozzle will again be chosen such that the heat energy effects a rapid cure to densify the sol-gel layer, without damaging the substrate material.

The practice of this invention can be better understood by reference to the following illustrative example:

EXAMPLE

An $SiO_2$ sol-gel solution is prepared from an alkoxide, an alcohol, and water, according to the formulations given in U.S. Pat. No. 5,856,018. A PMMA substrate, having a softening point of 100° C., is dip-coated into the sol-gel solution and then affixed to a transport arm like that depicted in FIG. 1, for transport past a pair of IR lamps and a hot-gas nozzle array. The lamps are each energized to a power of 50 watts per centimeter. The nozzles are symmetrically located approximately 0.5 to 2.0 centimeters from the substrate surfaces. A heated filament wire heats the gas, in this case purified air, to a temperature in the range of 300 to 350° C., and the heated gas is then delivered to the substrate surfaces at a rate in the range of 500 to 1000 cc/s. The substrate is transported past the heat sources at approximately 1.2 cm/s.

The substrate surface is measured to momentarily reach a temperature in the range of 110 to 150° C., but it does not warp or deform. The total time required to cure a 40-cm long coated substrate is approximately 35 seconds. The sol-gel coating is cured to the same extent as previously had been achieved in a 12-hour oven cure, at 84° C. The IR cured sol-gel coating is tested for mechanical strength and found to pass both a 5H pencil scratch test and a 10,000 cycle dry abrasion test. Again, these values are equal to results previously obtained during the 12-hour oven cure at 84° C.

Although the invention has been described with reference only to the preferred process, those skilled in the art will appreciate that various modifications to the preferred parameter combinations can be made without departing from the invention. Accordingly, the invention is defined only by the following claims.

We claim:

1. An apparatus for rapid heat-cure of sol-gel coatings adhered to a substrate, the apparatus comprising:

a supporting structure;

an IR heating source mounted on the supporting structure and configured to emit radiation in a predetermined pattern; and a transfer assembly configured to sequentially expose discrete segments of the coated substrate to the IR radiation at a selected distance and for a selected duration, such that the heat energy from the IR radiation sufficiently cures or densifies the sol-gel coating, but does not unduly heat the substrate to cause deformation.

2. An apparatus as defined in claim 1, wherein the transfer assembly is configured to transport the coated substrate past the heating source and the substrate is transported at a speed in the range of about 0.5 to about 50 centimeters per second.

3. An apparatus as defined in claim 1, wherein the IR source emits IR radiation at a power level in the range of about 40 to about 80 watts per centimeter.

4. An apparatus as defined in claim 1, and further comprising a gas nozzle mounted on the supporting structure in spaced relationship from the IR source, connectable to a heated gas source, and configured to expel a heated gas stream in a predetermined pattern.

5. An apparatus as defined in claim 4, wherein the transfer assembly is configured to transport the coated substrate past the IR heating source and the gas nozzle and the substrate is transported at a speed in the range of about 0.5 to about 50 centimeters per second.

6. An apparatus as defined in claim 4, wherein the IR heating source emits IR radiation at a power level in the range of about 40 to about 80 watts per centimeter.

7. An apparatus as defined in claim 4, wherein the IR heating source is two IR lamps in opposed relation to each other such that the coated substrate can pass therebetween at a selected distance from both.

8. An apparatus as defined in claim 4, further including a second gas nozzle in opposed relation to the first gas nozzle such that the coated substrate can pass therebetween at a selected distance from both.

9. An apparatus as defined in claim 4, wherein the substrate is a plastic material having a low melting point, wherein the plastic material is selected from the group consisting of polymethyl methacrylate, polycarbonate, polyester, and CR-39.

10. An apparatus as defined in claim 4, further including a heated gas source connected to the gas nozzle.

11. An apparatus as defined in claim 10, wherein the gas is selected from the group consisting of air, nitrogen, argon, helium, and combinations thereof.

12. An apparatus as defined in claim 10, wherein the heated gas source is configured to allow injecting steam, or other water forms, into the heated gas strewn.

13. An apparatus as defined in claim 10, wherein the temperature of the heated gas stream is in the range of about 100 to about 500° C. and the flow rate of the heated gas stream is in the range of about 50 to about 10,000 cubic centimeters per second.

14. A process for rapidly heat-curing a sol-gel coating adhered to a substrate, comprising sequentially exposing discrete segments of the coated substrate to an IR heating source at a selected distance and at a selected rate, wherein the IR heating source emits IR radiation in a predetermined pattern, and wherein the heat energy from the IR heating source sufficiently cures or densifies the sol-gel coating to its optimum physical and optical properties, but does not unduly heat the substrate to cause deformation.

15. A product produced by the process of claim 14.

16. A process as defined in claim 14, wherein the coated substrate is transported past the IR heating source and the substrate is transported at a speed in the range of about 0.5 to about 50 centimeters per second.

17. A process as defined in claim 14, wherein the IR heating source emits IR radiation at a power level in the range of about 40 to about 80 watts per centimeter.

18. A process as defined in claim 14, and further comprising a gas nozzle connectable to a heated gas source, and configured to expel a heated gas stream in a predetermined pattern.

19. A product produced by the process of claim 18.

20. A process as defined in claim 18, wherein the process is repeated to produce a product having multiple layers of sol-gel coatings.

21. A process as defined in claim 18, wherein the substrate is a plastic material having a low melting point, wherein the plastic material is selected from the group consisting of polymethyl methacrylate, polycarbonate, polyester, and CR-39.

22. A process as defined in claim 18, wherein the heated gas is selected from the group consisting of air, nitrogen, argon, helium, and combinations thereof.

23. A process as defined in claim 18, and further comprising introducing moisture into the curing process by injecting steam, or other water forms, into the heated gas stream.

24. A process as defined in claim 18, wherein the temperature of the heated gas stream is in the range of about 100 to about 500° C. and the flow rate of the healed gas stream is in the range of about 50 to about 10,000 cubic centimeters per second.

25. A process as defined in claim 18, wherein the substrate is sequentially exposed to the IR radiation from the IR heating source and the heated gas stream at a speed in the range of about 0.5 to about 50 centimeters per second.

26. A process as defined in claim 18, wherein the IR heating source emits IR radiation at a power level in the range of about 40 to about 80 watts per centimeter.

27. A process as defined in claim 18, wherein the sol-gel coating forms an optical coating and/or an abrasion coating.

28. A process as defined in claim 27, wherein the optical coating is a multi-layer optical stack that produces an antireflection coating.

* * * * *

UNITED STATES PATENT AND TRADEMARK OFFICE

CERTIFICATE OF CORRECTION

PATENT NO. : 6,871,418 B2
DATED : March 29, 2005
INVENTOR(S) : Raychaudhuri et al.

It is certified that error appears in the above-identified patent and that said Letters Patent is hereby corrected as shown below:

Title page,
Item [57], ABSTRACT,
Line 6, "densities" should be -- densifies --.

Column 2,
Line 13, "densities" should be -- densifies --.

Column 6,
Line 9, after "emit", please insert -- IR --.
Line 27, after "IR", please insert -- heating --.

Column 8,
Line 10, "healed" should be -- heated --.

Signed and Sealed this

Seventeenth Day of May, 2005

JON W. DUDAS
*Director of the United States Patent and Trademark Office*